US007186491B2

(12) United States Patent
Moudry et al.

(10) Patent No.: US 7,186,491 B2
(45) Date of Patent: Mar. 6, 2007

(54) NEGATIVELY CHARGED COATED ELECTROGRAPHIC TONER PARTICLES

(75) Inventors: Ronald J. Moudry, Woodbury, MN (US); Zbigniew Tokarski, Woodbury, MN (US)

(73) Assignee: Samsung Electronics Company, Suwon (KR)

( * ) Notice: Subject to any disclaimer, the term of this patent is extended or adjusted under 35 U.S.C. 154(b) by 340 days.

(21) Appl. No.: 10/841,876

(22) Filed: May 7, 2004

(65) Prior Publication Data

US 2005/0250035 A1 Nov. 10, 2005

(51) Int. Cl.
*G03G 9/00* (2006.01)

(52) U.S. Cl. ..... 430/108.23; 430/108.1; 430/110.2; 430/114

(58) Field of Classification Search ..... 430/108.23, 430/108.1, 110.2, 114
See application file for complete search history.

(56) References Cited

U.S. PATENT DOCUMENTS

| | | | | |
|---|---|---|---|---|
| 4,024,295 | A | 5/1977 | Chase et al. | |
| 4,071,304 | A | 1/1978 | Chauvin et al. | |
| 4,235,024 | A | 11/1980 | Chauvin et al. | |
| 4,268,598 | A | 5/1981 | Leseman et al. | 430/107 |
| 4,298,672 | A | 11/1981 | Lu | 430/108 |
| 4,321,404 | A | 3/1982 | Williams et al. | 560/115 |
| 4,413,048 | A | 11/1983 | Landa | 430/115 |
| 4,560,635 | A | 12/1985 | Hoffend et al. | 430/106.6 |
| 4,656,112 | A | 4/1987 | Kawagishi et al. | 430/110 |
| 4,728,983 | A | 3/1988 | Zwadlo et al. | 355/4 |
| 4,845,003 | A | 7/1989 | Kiriu et al. | 430/110 |
| 4,937,157 | A | 6/1990 | Haack et al. | 430/110 |
| 5,208,129 | A * | 5/1993 | Ciccarelli et al. | 430/108.2 |
| 5,262,259 | A | 11/1993 | Chou et al. | 430/47 |
| 6,255,363 | B1 | 7/2001 | Baker et al. | 523/201 |
| 2004/0091805 | A1 | 5/2004 | Qian et al. | 430/109.1 |
| 2004/0091806 | A1 | 5/2004 | Qian et al. | 430/109.31 |
| 2004/0091807 | A1 | 5/2004 | Qian et al. | 430/114 |
| 2004/0091808 | A1 | 5/2004 | Qian et al. | 430/114 |
| 2004/0091809 | A1 | 5/2004 | Qian et al. | 430/114 |

FOREIGN PATENT DOCUMENTS

EP 1219354 A1 9/2000

OTHER PUBLICATIONS

Commonly assigned U.S. Appl. No. 10/841,040, filed May 7, 2004, entitled "Positively Charged Coated Electrographic Toner Particles and Process".
Commonly assigned U.S. Appl. No. 10/841,753, filed May 7, 2004, entitled "Negatively Charged Coated Electrographic Toner Particles and Process".
Commonly assigned U.S. Appl. No. 10/841,754, filed May 7, 2004, entitled "Process for Coating Particles".
Commonly assigned U.S. Appl. No. 10/840,897, filed May 7, 2004, entitled "Positively Charged Coated Electrographic Toner Particles".
European Search Report for EP 05252781 issued on Sep. 20, 2005.

* cited by examiner

*Primary Examiner*—Mark A. Chapman
(74) *Attorney, Agent, or Firm*—Kagan Binder, PLLC

(57) ABSTRACT

Negatively charged coated toner particles are provided that comprise a plurality of polymeric binder particles that are substantially free of negatively charged pigment and a coating material comprising at least one negatively charged pigment coated on the outside surface of the polymeric binder particles. In one embodiment, a majority of the specific charge of the toner particles is contributed from the negatively charged pigment. In another embodiment, the toner particles are substantially free of additional charge director or charge control additive. Electrographic toner compositions comprising these particles are also provided.

13 Claims, No Drawings

NEGATIVELY CHARGED COATED ELECTROGRAPHIC TONER PARTICLES

FIELD OF THE INVENTION

The invention relates to electrographic toners. More specifically, the invention relates to negatively charged toner particles having a coating comprising a negatively charged pigment.

BACKGROUND

In electrophotographic and electrostatic printing processes (collectively electrographic processes), an electrostatic image is formed on the surface of a photoreceptive element or dielectric element, respectively. The photoreceptive element or dielectric element may be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227–252, and U.S. Pat. Nos. 4,728,983, 4,321,404, and 4,268,598.

In electrostatic printing, a latent image is typically formed by (1) placing a charge image onto a dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259.

In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like.

Electrophotography typically involves the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, and cleaning, and erasure.

In the charging step, a photoreceptor is covered with charge of a desired polarity, either negative or positive, typically using a corona or charging roller. In the exposure step, an optical system, typically a laser scanner or diode array, forms a latent image by selectively discharging the charged surface of the photoreceptor in an imagewise manner corresponding to the desired image to be formed on the final image receptor. In the development step, toner particles of the appropriate polarity are generally brought into contact with the latent image on the photoreceptor, typically using a developer electrically-biased to a potential opposite in polarity to the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

SUMMARY OF THE INVENTION

The present invention provides unique negatively charged coated toner particles comprising a plurality of polymeric binder particles that are substantially free of negatively charged pigment and a coating material comprising at least one negatively charged pigment coated on the outside surface of the polymeric binder particles. In one embodiment, the majority of the specific charge of the toner particles is contributed from the negatively charged pigment. In another embodiment, the toner particles are substantially free of additional charge director or charge control additive.

Toner particles as described herein have a unique configuration in that the negatively charged pigment is located on the surface of the toner particles, and is not located in the bulk of the polymeric binder particles. The use of a negatively charged pigment, and locating this pigment on the surface of the toner particle provides surprising performance properties in the resulting product. Surprisingly, the polarity of the resulting toner particle is in large part or completely afforded by the pigment component of the toner particle, and the toner particle is surprisingly effective for use in electrographic printing processes.

While not being bound by theory, it is believed that the location of the negatively charged pigment at the surface of the toner particle facilitates the contribution of the charge of the pigment to the overall polarity of the toner particle. Further, location of the pigment at the surface of the binder particle may provide better color saturation, thereby providing superior optical density without increasing the overall amount of visual enhancement additive in the toner particle as compared to prior art toners. Surprisingly, the location of the visual enhancement additive and optional other components at the surface of the binder particle does not adversely affect the adherence of the toner particle to the final substrate in imaging processes. In one particularly preferred embodiment, substantially all of the visual enhancement additive in the toner particle is located at the surface of the toner particle.

In another particularly preferred embodiment, the toner particle of the present invention is prepared from a binder comprising at least one amphipathic graft copolymer comprising one or more S material portions and one or more D material portions. Such amphipathic graft copolymers provide particular benefit in unique geometry of the copolymer that may particularly facilitate coating of polymeric binder particles with coating materials. In a particularly preferred embodiment, the S portion of the amphipathic graft copolymer may have a relatively low $T_g$, while the D portion has a higher $T_g$ than the S portion. This embodiment provides a polymeric binder particle having a surface that is highly receptive to coating with a coating material, while the overall $T_g$ of the polymeric binder particle is not so low as to provide a toner particle that blocks or sticks together during storage or use.

In a particularly preferred embodiment, toner particles comprising binder particles having selected polymeric materials surprisingly result in inherently generated negative toner particles. These binder particles readily provide negatively charged toner particles, where the charge is augmented by selection of negatively charged pigments to be located at the surface of the toner particle. Advantageously, likely classes of polymeric materials that result in inherently generated negative toner particles are randomly oriented polymers. In an alternative embodiment, the toner particle of the present invention may be prepared from a binder particle comprising selected polymeric materials that do not result in inherently generated negative toner particles. It has been found that, in particular, binder particles made from selected amphipathic graft copolymers result in inherently generated positive toner particles. Surprisingly, the inherent positive charge of these binder particles may be overcome by selection of negatively charged pigments to provide toner particles that have an overall negative charge. In one embodiment of this alternative embodiment, the inherently generated positive binder particles may be rendered negative by incorporating a negatively charged pigment in a coating on the surface of the particle, together with the use of negatively charged charge directors or charge control additives either in the binder particle or coating or both, to provide an overall negatively charged toner particle. In another embodiment of this alternative embodiment, the inherently generated positive binder particles may be rendered negative by incorporating a negatively charged pigment in a coating on the surface of the particle, wherein the toner particles are substantially free of additional negatively charged charge directors or charge control additives.

DETAILED DESCRIPTION

Negatively charged pigment is selected from any appropriate material that will provide visual enhancement of the toner particle while at the same time rendering the toner particle negatively charged. This combination of functionality provides a high degree of efficiency and benefits in manufacture and use of the toner particles as described herein. Preferred negatively charged pigments are selected from the group consisting of copper phthalocyanines, perylenes, quinacridones, azopigments, metal salt azopigments, azochromium complexes, and combinations thereof. Other preferred negatively charged pigments are pigments that have been surface treated with an acidic functional compound. For example, otherwise neutrally charged pigments when treated with compositions such as carboxylic acids, sulfonic acids, and carboxy or hydroxy functional polymers are effectively rendered negative in charge, and may be advantageously used in the toners of the present invention.

Examples of negatively charged pigments include phthalocyanine blue (C.I. Pigment Blue 15:1, 15:2, 15:3 and 15:4); monoarylide yellow (C.I. Pigment Yellow 1, 3, 65, 73 and 74); diarylide yellow (C.I. Pigment Yellow 12, 13, 14, 17 and 83); azo red (C.I. Pigment Red 3, 17, 22, 23, 38, 48:1, 48:2, 52:1, and 52:179); quinacridone magenta (C.I. Pigment Red 122, 202 and 209); and acid black pigments such as finely divided carbon (Cabot Regal 350R and Mogul L), and the like.

The amount of the negatively charged pigment, based on 100 parts by weight of the toner solids, is preferably 0.01 to 10 parts by weight, more preferably 0.1 to 5 parts by weight.

Negatively charged coated toner particles of the present invention preferably comprise sufficient pigment in the coating to substantially cover the surface of the binder particle. More preferably, the particles comprise sufficient pigment in the coating to completely cover the surface of the binder particle. The amount of coating material used depends on the desired properties sought by addition of the coating material and coating thickness.

In a preferred aspect of the present invention, the coating material is provided as a dry material. Coating materials, when in particulate form, can be of any of a wide variety of shapes such as, for example, spherical, flake, and irregular shapes.

Generally, the volume mean particle diameter ($D_v$) of the toner particles, determined by laser diffraction particle size measurement, preferably should be in the range of about 0.05 to about 50.0 microns, more preferably in the range of about 3 to about 10 microns, most preferably in the range of about 5 to about 7 microns. Preferably, the ratio of diameter of binder particle to the coating particle is greater than about 20.

Two types of toners are in widespread, commercial use: liquid toner and dry toner. The toner particles of the present invention may be used in either liquid or dry toner compositions for ultimate use in imaging processes. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

The binder of a toner composition fulfills functions both during and after electrographic processes. With respect to processability, the character of the binder impacts the triboelectric charging and charge retention characteristics, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact image durability (e.g. blocking and erasure resistance), adhesion to the receptor, gloss, and the like.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

Glass transition temperature, $T_g$, refers to the temperature at which a (co)polymer, or portion thereof, changes from a hard, glassy material to a rubbery, or viscous material, corresponding to a dramatic increase in free volume as the (co)polymer is heated. The $T_g$ can be calculated for a (co)polymer, or portion thereof, using known $T_g$ values for the high molecular weight homopolymers and the Fox equation expressed below:

$$1/T_g = w_1/T_{g1} + w_2/T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54–55 (1992).

In the practice of the present invention, values of $T_g$ for the polymer of the binder or portions thereof (such as the D or S portion of the graft copolymer) may be determined using the Fox equation above, although the $T_g$ of the copolymer as a whole may be determined experimentally using e.g., differential scanning calorimetry. The glass transition temperatures ($T_g$'s) of the S and D portions may vary over a wide range and may be independently selected to enhance manufacturability and/or performance of the resulting toner particles. The $T_g$'s of the S and D portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer (s) will be used.

When used as part of a polymeric binder particle composition, various suitable toner resins may be selected for coating with the coating material as described herein. Illustrative examples of typical resins include polyamides, epoxies, polyurethanes, vinyl resins, polycarbonates, polyesters, and the like and mixtures thereof. Any suitable vinyl resin may be selected including homopolymers or copolymers of two or more vinyl monomers. Typical examples of such vinyl monomeric units include: styrene; vinyl naphthalene; ethylenically unsaturated mono-olefins such as ethylene, propylene, butylene, isobutylene and the like; vinyl esters such as vinyl acetate, vinyl propionate, vinyl benzoate, vinyl butyrate and the like; ethylenically unsaturated diolefins, such as butadiene, isoprene and the like; esters of unsaturated monocarboxylic acids such as methyl acrylate, ethyl acrylate, n-butyl acrylate, isobutyl acrylate, dodecyl acrylate, n-octyl acrylate, phenyl acrylate, methyl methacrylate, ethyl methacrylate, butyl methacrylate and the like; acrylonitrile; methacrylonitrile; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and mixtures thereof. Also, there may be selected as toner resins various vinyl resins blended with one or more other resins, preferably other vinyl resins, which insure good triboelectric properties and uniform resistance against physical degradation. Furthermore, nonvinyl type thermoplastic resins may also be employed including resin modified phenolformaldehyde resins, oil modified epoxy resins, polyurethane resins, cellulosic resins, polyether resins, polyester resins, and mixtures thereof.

Such polymeric binder particles may be manufactured using a wide range of fabrication techniques. One widespread fabrication technique involves melt mixing the ingredients, comminuting the solid blend that results to form particles, and then classifying the resultant particles to remove fines and larger material of unwanted particle size.

Preferably, the polymeric binder particle comprises a graft amphipathic copolymer. The polymeric binder particles comprise a polymeric binder comprising at least one amphipathic copolymer with one or more S material portions and one or more D material portions.

As used herein, the term "amphipathic" refers to a copolymer having a combination of portions having distinct solubility and dispersibility characteristics in a desired liquid carrier that is used to make the copolymer. Preferably, the liquid carrier (also sometimes referred to as "carrier liquid") is selected such that at least one portion (also referred to herein as S material or block(s)) of the copolymer is more solvated by the carrier while at least one other portion (also referred to herein as D material or block(s)) of the copolymer constitutes more of a dispersed phase in the carrier.

From one perspective, the polymer particles when dispersed in the liquid carrier may be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material may also be referred to herein as a "graft stabilizer." The core/shell structure of the binder particles tends to be retained when the particles are dried when incorporated into liquid toner particles.

Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

The materials of the polymeric binder particle are preferably selected to provide inherently negative toner particles. As a general principle, such polymers include styrene, styrene butyl acrylate, styrene butyl methacrylate and certain polyesters. Alternatively, the polymers of the polymeric binder particle may be used that will inherently result in particles having a positive charge. As a general principle, many acrylate and methacrylate based polymers generate inherently positive toner particles. Preferred such polymers include polymers formed comprising one or more C1–C18 esters of acrylic acid or methacrylic acid monomers. Particular acrylates and methacrylates that are preferred for incorporation into amphipathic copolymers for binder particles include isononyl (meth)acrylate, isobornyl (meth) acrylate, 2-ethylhexyl (meth)acrylate, isobutyl (meth)acrylate, isodecyl (meth)acrylate, lauryl (dodecyl) (meth) acrylate, stearyl (octadecyl) (meth)acrylate, behenyl (meth) acrylate, n-butyl (meth)acrylate, methyl (meth)acrylate, ethyl (meth)acrylate, hexyl (meth)acrylate, isooctyl (meth) acrylate, combinations of these, and the like.

When the overall tendency of the polymers used in the polymeric binder particle would result in a positive toner particle, the pigment may be selected and provided in an amount sufficient to impart an overall negative charge to the toner particle. Optionally, additional negatively charged charge directors or charge control additives may be incorporated in the coating material to assist in providing an overall negative charge to the toner particle.

As noted above, the toner particles of the present invention may be used in either dry or liquid toner compositions. The selection of the polymeric binder material will in part be determined by the ultimate imaging process in which the toner particles are to be used. Polymeric binder materials suitable for use in dry toner particles typically have a high glass transition temperature ($T_g$) of at least about 50–65° C. in order to obtain good blocking resistance after fusing, yet typically require high fusing temperatures of about 200–250° C. in order to soften or melt the toner particles and thereby adequately fuse the toner to the final image receptor. High fusing temperatures are a disadvantage for dry toner because of the long warm-up time and higher energy consumption associated with high temperature fusing and because of the risk of fire associated with fusing toner to paper at temperatures approaching the autoignition temperature of paper (233° C.).

In addition, some dry toners using high $T_g$ polymeric binders are known to exhibit undesirable partial transfer (offset) of the toned image from the final image receptor to the fuser surface at temperatures above or below the optimal fusing temperature, requiring the use of low surface energy materials in the fuser surface or the application of fuser oils to prevent offset. Alternatively, various lubricants or waxes have been physically blended into the dry toner particles during fabrication to act as release or slip agents; however, because these waxes are not chemically bonded to the polymeric binder, they may adversely affect triboelectric charging of the toner particle or may migrate from the toner particle and contaminate the photoreceptor, an intermediate transfer element, the fuser element, or other surfaces critical to the electrophotographic process.

Polymeric binder materials suitable for use in liquid toner compositions may utilize a somewhat different selection of polymer components to achieve the desired $T_g$ and solubility properties. For example, the liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter of from about 0.1 to about 1 micron. Due to this relatively low Tg value, such particles are not generally not favored in the processes as described herein, because the storage and processing of such particles in the dry form present special handling issues to avoid blocking and sticking of the particles together. It is contemplated that special handling procedures may be utilized in this embodiment, such as maintenance of the ambient temperature of the particles when in the dry form below the temperature in which blocking or sticking takes place. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68–74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter of from about 3 to about 10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

Preferred graft amphipathic copolymers for use in the binder particles are described in Qian et al, U.S. Ser. No. 10/612,243, filed on Jun. 30, 2003, entitled ORGANOSOL INCLUDING AMPHIPATHIC COPOLYMERIC BINDER AND USE OF THE ORGANOSOL TO MAKE DRY TONERS FOR ELECTROGRAPHIC APPLICATIONS and Qian et al., U.S. Ser. No. 10/612,535, filed on Jun. 30, 2003, entitled ORGANOSOL INCLUDING AMPHIPATHIC COPOLYMERIC BINDER HAVING CRYSTALLINE MATERIAL, AND USE OF THE ORGANOSOL TO MAKE DRY TONER FOR ELECTROGRAPHIC APPLICATIONS for dry toner compositions; and Qian et al., U.S. Ser. No. 10/612,534, filed on Jun. 30, 2003, entitled ORGANOSOL LIQUID TONER INCLUDING AMPHIPATHIC COPOLYMERIC BINDER HAVING CRYSTALLINE COMPONENT; Qian et al., U.S. Ser. No. 10/612,765, filed on Jun. 30, 2003, entitled ORGANOSOL INCLUDING HIGH Tg AMPHIPATHIC COPOLYMERIC BINDER AND LIQUID TONER FOR ELECTROPHOTOGRAPHIC APPLICATIONS; and Qian et al., U.S. Ser. No. 10/612,533, filed on Jun. 30, 2003, entitled ORGANOSOL INCLUDING AMPHIPATHIC COPOLYMERIC BINDER MADE WITH SOLUBLE HIGH Tg MONOMER AND LIQUID TONERS FOR ELECTROPHOTOGRAPHIC APPLICATIONS for liquid toner compositions, which are hereby incorporated by reference. Particularly preferred graft amphipathic copolymers for use in the binder particles comprise an S portion having a glass transition temperature calculated using the Fox equation (excluding grafting site components) of at least about 90° C., and more preferably from about 100° C. to about 130° C.

Optionally, additional visual enhancement additive may be provided either in the binder particle or in the coating material to further enhance the visual appearance of the toner particle. Preferably, the additional visual enhancement additive has a neutral charge. Optionally, the additional visual enhancement additive may be negatively charged, but in such a case should be present only to the extent that the negative charge of the toner particle is not compromised. The visual enhancement additive(s) generally may include any one or more fluid and/or particulate materials that provide a desired visual effect when toner particles incorporating such materials are printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive coated on binder particles may vary over a wide range. In representative embodiments, a suitable weight ratio of copolymer to visual enhancement additive is from 1/1 to 20/1, preferably from 2/1 to 10/1 and most preferably from 4/1 to 8/1.

Useful colorants are well known in the art and include materials listed in the Colour Index, as published by the Society of Dyers and Colourists (Bradford, England), including dyes, stains, and pigments. Preferred colorants are pigments which may be combined with ingredients comprising the binder polymer to form dry toner particles with structure as described herein, are at least nominally insoluble in and nonreactive with the carrier liquid, and are useful and effective in making visible the latent electrostatic image. It is understood that the visual enhancement additive(s) may also interact with each other physically and/or chemically, forming aggregations and/or agglomerates of visual enhancement additives that also interact with the binder polymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), isoindoline yellow (C.I. Pigment Yellow 138), azo red (C.I. Pigment Red 3, 17, 22, 23, 38, 48:1, 48:2, 52:1, and 52:179), quinacridone magenta (C.I. Pigment Red 122, 202 and 209), laked rhodamine magenta (C.I. Pigment Red 81:1, 81:2, 81:3, and 81:4), and black pigments such as finely divided carbon (Cabot Monarch 120, Cabot Regal 300R, Cabot Regal 350R, Vulcan X72, and Aztech EK 8200), and the like.

The toner particles of the present invention may additionally comprise one or more additives as desired. Additional additives include, for example, UV stabilizers, mold inhibitors, bactericides, fungicides, antistatic agents, gloss modifying agents, other polymer or oligomer material, antioxidants, and the like.

These additives may be incorporated in the binder particle prior to coating, or may be incorporated in the coating material, or both. When the additives are incorporated in the binder particle prior to coating, the binder particle is combined with the desired additive and the resulting composition is then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated additive particles, when present, into primary particles (preferably having a diameter of from about 0.005 to about 5 microns, more preferably having a diameter of from about 0.05 to about 3 microns, and most preferably having a diameter of from about 0.1 to about 1 microns) and may also partially shred the binder into fragments that can associate with the additive. According to this embodiment, the copolymer or fragments derived from the copolymer then associate with the additives. Optionally, one or more visual enhancement agents may be incorporated within the binder particle, as well as coated on the outside of the binder particle.

When the ultimate toner composition is to be a dry toner, one or more charge control agents can be added before or after this mixing process, if desired.

After preparation of the polymeric binder particles, the particles are prepared for coating. In the preferred coating process of the present invention, the binder particles are dried for coating. The manner in which the dispersion is dried may impact the degree to which the resultant toner particles may be agglomerated and/or aggregated. In preferred embodiments, the particles are dried while fluidized, aspirated, suspended, or entrained (collectively "fluidized") in a carrier gas to minimize aggregation and/or agglomeration of the dry toner particles as the particles dry. In practical effect, the fluidized particles are dried while in a low density condition. This minimizes interparticle collisions, allowing particles to dry in relative isolation from other particles. Such fluidizing may be achieved using vibration energy, electrostatic energy, a moving gas, combinations of these, and the like. The carrier gas may comprise one or more gases that may be generally inert (e.g. nitrogen, air, carbon dioxide, argon, or the like). Alternatively, the carrier gas may include one or more reactive species. For instance, an oxidizing and/or reducing species may be used if desired. Advantageously, the product of fluidized drying constitutes free flowing dry toner particles with a narrow particle size distribution.

As one example of using a fluidized bed dryer, the liquid toners may be filtered or centrifuged to form a wet cake. The wet filter cake may be placed into the conical drying chamber of a fluid bed dryer (such as that available from Niro Aeromatic, Niro Corp., Hudson, Wis.). Ambient air at about 35–50° C., or preferably lower than the $T_g$ of the copolymer, may be passed through the chamber (from bottom to top) with a flow rate sufficient to loft any dried powder and to keep the powder airborne inside the vessel (i.e., a fluidized powder bed). The air may be heated or otherwise pretreated. Bag filters in the vessel allow the air to leave the drying vessel while keeping the powder contained. Any toner that accumulates on the filter bags may be blown down by a periodic reverse air flow through the filters. Samples may be dried anywhere from 10–20 minutes to several hours, depending on the nature of the solvent (e.g. boiling point), the initial solvent content, and the drying conditions.

As noted above, unique negatively charged toner particles may be prepared by a magnetically assisted coating process as generally described herein, and more completely described in copending commonly assigned application Ser. No. [SAM0032/US], Moudry et al, entitled NEGATIVELY CHARGED COATED ELECTROGRAPHIC TONER PARTICLES, filed on even date with the present application. In another process, unique negatively charged toner particles may be prepared by a vibrationally assisted interfacial coating process as generally described herein, and more completely described in copending commonly assigned application Ser. No. [SAM0033/US], Tokarski et al, entitled PROCESS FOR COATING PARTICLES, filed on even date with the present application. Alternatively, other coating processes capable of providing negatively charged coated toner particles that are coated on the outside surface of the polymeric binder particle by a coating material comprising at least one negatively charged pigment may be used. For example, coating processes such as spray coating, solvent evaporation coating or other such processes capable of providing a layer as described herein may be utilized as will now be appreciated by the skilled artisan.

In the preferred magnetically assisted coating process, a blend of a coating material and polymeric binder particles is provided, wherein the blend comprises magnetic elements. This blend is exposed to a magnetic field that varies in direction with time; whereby the movement of the magnetic elements in the magnetic field provides sufficient force to cause the coating material to adhere to the surface of the polymeric binder particle to form a negatively charged coated toner particle.

The coating material is applied onto the binder particle by the action of the coating material or binder particle if magnetic in character or by the action of additional magnetic elements in a varying magnetic field which causes peening of the coating materials onto the binder particle. When neither the coating material nor the particulate binder particle is magnetic, the varying magnetic field causes impingement of the magnetic elements into the coating material which forces the material onto the binder particle with a peening action.

Alternatively, the coating material may be provided in liquid form. In this embodiment, the liquid may be introduced into the composition either independently of the particulate binder particle to be coated (e.g., added before, after or during initiation of the movement of the magnetic particles, before, with or after any introduction of any non-magnetic particles to be coated, by spray, injection, dripping, carriage on other particles, and any other method of providing liquid into the chamber so that it may be contacted by moving particles and distributed throughout the coating chamber) or added with particulate materials (e.g., the particles, either magnetic or non-magnetic, may be pretreated or pre-coated with liquid and the particle movement process initiated or coated, or the liquid may be added simultaneously through the same or different inlet means). Pre-treated (pre-coated) magnetic particles may be provided before or during movement of the particles. Non-magnetic particles may be added before or during movement of the particles. All that needs to be done to accomplish liquid coating of particles within the bed is to assure that at some time during particle movement, both the liquid to be coated and the particles which are desired to be coated are present within the system. The physical forces operating within the system will assure that the liquid is evenly spread over the particles if the particles and liquid are allowed to remain in the system for a reasonable time. The time during which the system equilibrates may range from a few seconds to minutes, partially dependent upon the viscosity of the liquid. The higher the viscosity of the liquid, the more time it takes for the liquid to be spread over the particles surfaces. This time factor can be readily determined by routine experimentation and can be estimated and correlated from the viscosity, particle sizes, relative wetting ability of the liquid for the particle surface and other readily observable characteristics of the system.

In an alternative coating process, the coating material comprising negatively charged pigment is coated onto polymeric binder particles by use of vibrational force. In this process, a blend comprising the coating material and polymeric binder particles is provided in a coating vessel. The coating vessel comprising the blend is exposed to vibrational force in an amount sufficient to cause the coating material and the polymeric binder particles to collide with sufficient force to cause the coating material to adhere to the surface of the polymeric binder particle. As above, the coating material may be provided in particulate or liquid form.

After coating of the binder particle with the coating composition comprising visual enhancement additive, the resulting toner particle may optionally be further processed by additional coating processes or surface treatment such as spheroidizing, flame treating, and flash lamp treating. The toner particles may then be provided as a toner composition, ready for use, or blended with additional components to form a toner composition.

Optionally, the toner particles may be provided as a liquid toner composition by suspending or dispersing the toner particles in a liquid carrier. The liquid carrier is typically nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

The liquid carrier of the liquid toner composition is preferably a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water. The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

Exemplary characteristics of the overall composition to make preferred dry toners of the present invention are described, for example, in Qian et al. applications: U.S. Ser. No. 10/612,243, filed on Jun. 30, 2003 and U.S. Ser. No. 10/612,535, filed on Jun. 30, 2003.

Exemplary characteristics of the overall composition to make preferred liquid toners of the present invention are described, for example, in Qian et al. applications: U.S. Ser. No. 10/612,534, filed on Jun. 30, 2003; U.S. Ser. No. 10/612,765, filed on Jun. 30, 2003; and U.S. Ser. No. 10/612,533, filed on Jun. 30, 2003.

Toners of the present invention are in a preferred embodiment used to form images in electrographic processes, including electrophotographic and electrostatic processes.

In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like.

Electrophotography typically involves the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, and cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively discharging the charged surface of the photoreceptor in an imagewise manner corresponding to the desired image to be formed on the final image receptor. In the development step, toner particles of the appropriate polarity are generally brought into contact with the latent image on the photoreceptor, typically using a developer electrically-biased to a potential opposite in polarity to the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

The invention will further be described by reference to the following nonlimiting examples.

EXAMPLES

Test Methods and Apparatus

In the following toner composition examples, percent solids of the graft stabilizer solutions and the organosol and liquid toner dispersions were determined thermo-gravimetrically by drying in an aluminum weighing pan an originally-weighed sample at 160° C. for four hours, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using tetrahydrofuran as the carrier solvent. Absolute weight average molecular weight were determined using a Dawn DSP-F light scattering detector (Wyatt Technology Corp., Santa Barbara, Calif.), while polydispersity was evaluated by the ratio of the measured weight average molecular weight value to the number average molecular weight value determined with an Optilab 903 differential refractometer detector (Wyatt Technology Corp., Santa Barbara, Calif.).

Organosol and liquid toner particle size distributions were determined by the Laser Diffraction Light Scattering Method using a Horiba LA-900 or LA-920 laser diffraction particle size analyzer (Horiba Instruments, Inc., Irvine, Calif.). Liquid samples were diluted approximately 1/10 by volume in Norpar™ 12 and sonicated for one minute at 150 watts and 20 kHz prior to measurement in the particle size analyzer according to the manufacturer's instructions. Dry toner particle samples were dispersed in water with 1% Triton X-100 surfactant added as a wetting agent. Particle size was expressed as both a number mean diameter ($D_n$) and a volume mean diameter ($D_v$) and in order to provide an indication of both the fundamental (primary) particle size and the presence of aggregates or agglomerates.

One important characteristic of xerographic toners is the toner's electrostatic charging performance (or specific charge), given in units of Coulombs per gram. The specific charge of each toner was established in the examples below using a blow-off tribo-tester instrument (Toshiba Model TB200 Blow-Off Powder Charge measuring apparatus with size #400 mesh stainless steel screens pre-washed in tetrahydrofuran and dried over nitrogen, Toshiba Chemical Co., Tokyo, Japan). To use this device, the toner is first electrostatically charged by combining it with a carrier powder. The carrier is a ferrite powder coated with a polymeric shell. The toner and the coated carrier particles are brought together to form the developer in a plastic container. When the developer is gently agitated using a U.S. Stoneware mill mixer, tribocharging results in both of the component powders acquiring an equal and opposite electrostatic charge, the magnitude of which is determined by the properties of the toner, along with any compounds deliberately added to the toner to affect the charging (e.g., charge control agents).

Once charged, the developer mixture is placed in a small holder inside the blow-off tribo-tester. The holder acts a charge-measuring Faraday cup, attached to a sensitive capacitance meter. The cup has a connection to a compressed dry nitrogen gas line and a fine screen at its base, sized to retain the larger carrier particles while allowing the smaller toner particles to pass. When the gas line is pressurized, gas flows thought the cup and forces the toner particles out of the cup through the fine screen. The carrier particles remain in the Faraday cup. The capacitance meter in the tester measures the charge of the carrier; the charge on the toner that was removed is equal in magnitude and opposite in sign. A measurement of the amount of toner mass lost yields the toner specific charge, in microCoulombs per gram of developer.

For the present measurements, a polyvinylidene fluoride (PVDF) coated ferrite carrier (Canon 3000–4000 carrier, K101, Type TefV 150/250, Japan) with a mean particle size of about 150 microns was used. Toner was added to the carrier powder to obtain a 5 weight percent toner content in the developer. This developer was gently agitated using a U.S. Stoneware mill mixer for 5 min, 15 min, and 30 min intervals before blow-off testing. Specific charge measurements were repeated at least three times for each toner to obtain a mean value and a standard deviation. Tests were considered valid if nearly all of toner mass is blown-off from the carrier beads. Tests with low mass loss are rejected.

Thermal transition data for synthesized toner material was collected using a TA Instruments Model 2929 Differential Scanning Calorimeter (New Castle, Del.) equipped with a DSC refrigerated cooling system (−70° C. minimum temperature limit), and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5–10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature value—values are reported from either the third or fourth heat ramp.

Materials

The following abbreviations are used in the examples:

St: Styrene (available from Aldrich Chemical Co., Milwaukee, Wis.)

nBA: n-Butyl acrylate (available from Aldrich Chemical Co., Milwaukee, Wis.)

MAA: Methacrylic acid (available from Aldrich Chemical Co., Milwaukee, Wis.)

HEMA: 2-Hydroxyethyl methacrylate (available from Aldrich Chemical Co., Milwaukee, Wis.)

TCHMA: Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

AIBN: azobisisobutyronitrile (an initiator available as VAZO-64 from DuPont Chemical Co., Wilmington, Del.)

DBTDL: Dibutyl tin dilaurate (a catalyst available from Aldrich Chemical Co., Milwaukee, Wis.)

V-601: Dimethyl 2,2'-azobisisobutyrate (an initiator available as V-601 from WAKO Chemicals U.S.A., Richmond, Va.)

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) is designated TCHMA/HEMA-TMI (97/3-4.7), and is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97-3-4.7//100) is made by copolymerizing the designated graft stabilizer (TCHMA/HEMA-TMI (97/3-4.7)) (S portion or shell) with the designated core monomer EMA (D portion or core) at a specified ratio of D/S (core/shell) determined by the relative weights reported in the examples.

EXAMPLE 1

Step 1. Graft Stabilizer Preparation

A 50 gallon reactor equipped with a condenser, a thermocouple connected to a digital temperature controller, a nitrogen inlet tube connected to a source of dry nitrogen and a mixer, was charged with a mixture of 201.9 lb of Norpar™ 12, 66.4 lb of TCHMA, 2.10 lb of 98% HEMA and 0.86 lb of V-601. While stirring the mixture, the reactor was purged with dry nitrogen for 30 minutes at flow rate of approximately 2 liters/minute, and the nitrogen flow rate was reduced to approximately 0.5 liters/min. The mixture was heated to 75° C. for 4 hours. The conversion was quantitative.

The mixture was heated to 100° C. and held at that temperature for 1 hour to destroy any residual V-601, and then was cooled back to 70° C. The nitrogen inlet tube was then removed, and 0.11 lb of 95% DBTDL was added to the mixture, followed by 3.23 lb of TMI. The TMI was added drop wise over the course of approximately 5 minutes while stirring the reaction mixture. The mixture was allowed to react at 70° C. for 2 hours, at which time the conversion was quantitative.

The mixture was then cooled to room temperature. The cooled mixture was a viscous, transparent liquid containing no visible insoluble mater. The percent solids of the liquid mixture was determined to be 26.2% using the Halogen Drying Method described above. Subsequent determination of molecular weight was made using the GPC method described above; the copolymer had a $M_w$ of 251,300 and $M_w/M_n$ of 2.8 based on two independent measurements. The product is a copolymer of TCHMA and HEMA containing random side chains of TMI and is designed herein as TCHMA/HEMA-TMI (97/3-4.7% w/w) and can be used to make an organsol.

Step 2. Organosol Particle Preparation

A 5 litre 3-necked round bottom flask equipped with a condenser, a thermocouple connected to a digital temperature controller, a nitrogen inlet tube connected to a source of dry nitrogen and an overhead stirrer, was charged with a mixture of 2573 g of Norpar™ 12, 486.08 g of styrene (commercially available from Aldrich Chemical, Milwaukee, Wis.), 98.81 g of n-butylacrylate (commercially available from Aldrich Chemical, Milwaukee, Wis.), 35.09 g of methacrylic acid (commercially available from Aldrich Chemical, Milwaukee, Wis.), 296.86 g of the graft stabilizer mixture prepared above (26.2%) and 10.50 g of AIBN. While the mixture was stirred, the reaction flask was purged with dry nitrogen for 30 minutes at a flow rate of approximately 2 liters/minute. A hollow glass stopper was then inserted into the open end of the condenser and the nitrogen flow rate was reduced to approximately 0.5 liter/min. The mixture was heated to 70° C. with stirring, and the mixture was allowed to polymerize at 70° C. for 16 hours. The conversion was quantitative.

Approximately 350 g of n-heptane were added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was cooled to room temperature, yielding an opaque white gel.

The particles were allowed to settle down and the mixture of ethyl alcohol and water was removed, and the concentration was tray-dried at room temperature under a hood with high air circulation. The percent of solids of this non-gel organosol dispersion was determined to be 18%. Subsequent determination of average particle size of the dried polymer was made using the Horiba 920 laser light scattering particle size analyzer (Horiba Instruments, Inc., Irvine, Calif.), which gave a volume average particle size of 10.3 microns. The glass transition temperature was measured using DSC, as described above. The particles had a $T_g$ of 68.54° C.

Step 3. Dry Toner by VAIC Coating of Pigment onto Organosol Particle

Solid binder particles were coating by use of a Vibrationally Assisted Interfacial Coating ("VAIC") as generally described above. The coating procedure was as follows:

Procedure:

1) About 40 grams of a mixture of dried polymer particles and 5 grams of pigment are mixed with about 50 g of 0.8–1.2 mm crystallized glass beads (such as Hi Bea Ceram C-20, 0.8–1.2 mm diameter, Hv hardness 880 Kgf/mm, specific density 3.18 g/cm$^3$ obtained from Ohara Corp. New Jersey, USA) and are added to a clean, thin aluminum rectangular tray. Preferably, all of the charge is added prior to fluidization. It is understood that the addition sequence and addition time relative to fluidization can be varied.
2) The tray is rested on top of the two speakers. No tray support bracket is used.
3) The frequency and amplitude are selected to obtain, by visual inspection, the greatest amount of fluidization of the material and media without loss of the material over the sides of the tray. Note: a cover may be used that will prevent the material from escaping from the tray. The amplifier is set at maximum output.
4) The sample is stirred with a spatula every 10–15 min to redistribute the toner to ensure uniform exposure of the toner to the VAIC coater speakers. After 2 hr of continuous operation, the sample is sifted to remove the glass media beads from the coated toner material using an 8-inch diameter, No. 35, US Standard Testing Sieve (500 μm nominal opening, 315 μm nominal wire diameter, obtained from VWR Scientific, USA).

EXAMPLE 2

The dried polymer particles obtained from Example 1 were combined with carbon black pigment (Mogul L, Cabot Corporation, Billerica, Mass.) and charge control agent (Hostacopy N4P N203 VP2655 available from Clariant Corp., Coventry, R.I.). Table 1 summaries the samples prepared for VAIC coating.

TABLE 1

Sample Descriptions

| Sample ID | Binder | Pigment (wt %) | CCA (wt %) | VAIC Residence Time (min) | VAIC Power Lever |
|---|---|---|---|---|---|
| 1 | 90 | 10 | 0 | 120 | 34.5 Hz/4.5 watts |
| 2 | 89 | 9.9 | 1.1 | 120 | 34.5 Hz/4.5 watts |

Sample 1 was prepared by combining 40.5 g of the dried polymer made in Step 3 of Example 1, 4.5 g of the black pigment, and 200 g of the crystallized glass media beads in a clean, thin aluminum rectangular tray. In this situation, all of the charge was added prior to VAIC coating. It is understood that the addition sequence and addition time relative to fluidization can be varied.

Sample 2 was prepared by combining 40.5 g of the dried polymer made in Step 3 of Example 1, 4.5 g of the black pigment, 0.5 g of charge control agent, and 200 g of the crystallized glass media beads in a clean, thin aluminum rectangular tray. In this situation, all of the charge was added prior to VAIC coating. It is understood that the addition sequence and addition time relative to fluidization can be varied.

3. Evaluation of Toner Particles

1) Q/M by Blow-Off Tester

The 2 VAIC coated samples obtained in Example 2 were mixed (0.5 g per sample) with a carrier powder (9.5 g, Canon 3000–4000 carrier, K101, Type TefV 150/250, Japan)). After low speed mixing of 5, 15 and 30 minutes, the 0.2 g of toner/carrier developer was analyzed using a Toshiba Blow-off tester to obtain the specific charge (in microCoulombs/gram) of each developer. At least three such measurements were made, yielding a mean value and a standard deviation. The data was monitored for quality, namely, a visual observation that nearly all of the toner was blown off of the carrier during the measurement. Toners of known charging properties were also run as test calibration standards.

2) Toner Particle Size

The VAIC coated samples obtained from Example 2 were dispersed in Norpar™ 12 which contain 1% Aerosol OT (dioctyl sodium sulfosuccinate, sodium salt, Fisher Scientific, Fairlawn, N.J.). The toner particle size was measured using a Horiba LA-900 laser diffraction particle size analyzer, as described above.

The toner particle size and charge (Q/M) values were determined for each material, as listed in Table 2.

TABLE 2

Dry Toner By VAIC

| Sample ID | $D_v$ (μm) | Q/M Test Section (min) | Q/M (μC/g) |
|---|---|---|---|
| 1 | 9.1 | 5 | −18.35 |
| | | 15 | −15.4 |
| | | 30 | −12.7 |
| 2 | 9.1 | 5 | −15.06 |
| | | 15 | −16.30 |
| | | 30 | −18.46 |

All patents, patent documents, and publications cited herein are incorporated by reference as if individually incorporated. Unless otherwise indicated, all parts and percentages are by weight and all molecular weights are weight average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

The invention claimed is:

1. Negatively charged coated toner particles comprising a) a plurality of polymeric binder particles that are substantially free of negatively charged pigment; and b) a coating material comprising at least one negatively charged pigment coated on the outside surface of the polymeric binder particles;

wherein a majority of the specific charge of the toner particles is contributed from the negatively charged pigment.

2. The negatively charged coated toner particles of claim 1, wherein the negatively charged pigment is selected from the group consisting of copper thalocyanine, peralene, quinadoone red, azo pigments, metal salt azo pigments, azo chromium complexes, and combinations thereof.

3. The negatively charged coated toner particles of claim 1, wherein the negatively charged pigment is a pigment that has been surface treated with an acidic functional compound.

4. The negatively charged coated toner particles of claim 1, wherein the polymeric binder particles are formed from random polymers.

5. The negatively charged coated toner particles of claim 1, wherein the polymeric binder particles are formed from a polymeric binder comprising at least one amphipathic graft copolymer comprising one or more S material portions and one or more D material portions.

6. The negatively charged coated toner particles of claim 1, further comprising an additional charge director or charge control additive in the coating material, wherein the polymeric binder particles that are substantially free of additional charge director or charge control additive.

7. A dry negative electrographic toner composition comprising a plurality of negatively charged toner particles of claim 1.

8. The dry negative electrographic toner composition of claim 7, wherein the negatively charged coated toner particles comprise magnetic elements.

9. The dry negative electrographic toner composition of claim 7, wherein the negatively charged coated toner particles are substantially free of magnetic elements.

10. A liquid negative liquid electrographic toner composition comprising:

a) a liquid carrier having a Kauri-Butanol number less than about 30 mL;

b) a plurality of negatively charged toner particles of claim 1 dispersed in the liquid carrier.

11. The liquid negative liquid electrographic toner composition of claim 10, wherein the negatively charged coated toner particles comprise magnetic elements.

12. The liquid negative liquid electrographic toner composition of claim 10, wherein the negatively charged coated toner particles are substantially free of magnetic elements.

13. Negatively charged coated toner particles comprising a) a plurality of polymeric binder particles that are substantially free of negatively charged pigment; and b) a coating material comprising at least one negatively charged pigment coated on the outside surface of the polymeric binder particles, said toner particles being substantially free of additional charge director or charge control additive.

* * * * *